US006378911B1

(12) United States Patent
Grohe

(10) Patent No.: US 6,378,911 B1
(45) Date of Patent: Apr. 30, 2002

(54) SYSTEM OF SANITARY FITTINGS

(75) Inventor: Klaus Grohe, Schiltach (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 09/454,665

(22) Filed: Dec. 3, 1999

(30) Foreign Application Priority Data

Dec. 5, 1998 (DE) ..... 198 56 155

(51) Int. Cl.[7] ..... F16K 27/04
(52) U.S. Cl. ..... 285/125.1; 137/269
(58) Field of Search ..... 4/670, 676, 677, 4/678, 695, 696; 137/269, 367; 285/12, 125.1

(56) References Cited

U.S. PATENT DOCUMENTS

| | | | | |
|---|---|---|---|---|
| 685,876 A | * | 11/1901 | Shields | 285/125.1 X |
| 2,898,079 A | * | 8/1959 | Rittenhouse | 137/269 X |
| 3,072,148 A | * | 1/1963 | Carls | 285/125.1 X |
| 3,176,954 A | * | 4/1965 | Cameron et al. | 137/269 |
| 3,934,605 A | * | 1/1976 | Legris | 137/269 |
| 4,938,251 A | * | 7/1990 | Furrow et al. | 137/269 |
| 5,730,184 A | | 3/1998 | Monch | 137/597 |
| 5,896,884 A | * | 4/1999 | Hettinger | 137/269 |
| 5,964,481 A | * | 10/1999 | Buch | 285/125.1 |

FOREIGN PATENT DOCUMENTS

| | | | | |
|---|---|---|---|---|
| DE | 83 27 503 | | 9/1983 | |
| DE | 35 19 652 | | 12/1986 | |
| DE | 87 06 453 | | 5/1987 | |
| DE | 38 16 519 A1 | | 12/1988 | |
| DE | A 39 03 997 | | 8/1990 | |
| DE | A 196 05 328 | | 8/1997 | |
| DE | A 196 22 368 | | 12/1997 | |
| EP | B 309 397 | | 4/1992 | |
| EP | B 05 76 391 | | 5/1993 | |
| EP | 0 590 960 A1 | | 4/1994 | |
| WO | wo-92/04568 | * | 3/1992 | 137/269 |
| WO | WO-A 94/19 633 | | 9/1994 | |

* cited by examiner

*Primary Examiner*—Lynne H. Browne
*Assistant Examiner*—David E. Bochna
(74) *Attorney, Agent, or Firm*—Duane Morris LLP

(57) ABSTRACT

A system of sanitary fittings contains a connecting block having an identical construction for all the fittings and which can be connected to the water pipes of a plumbing system. The connecting block contains a joint face into which issue the through openings, which are connected to the pipe connections.

Figure 1:
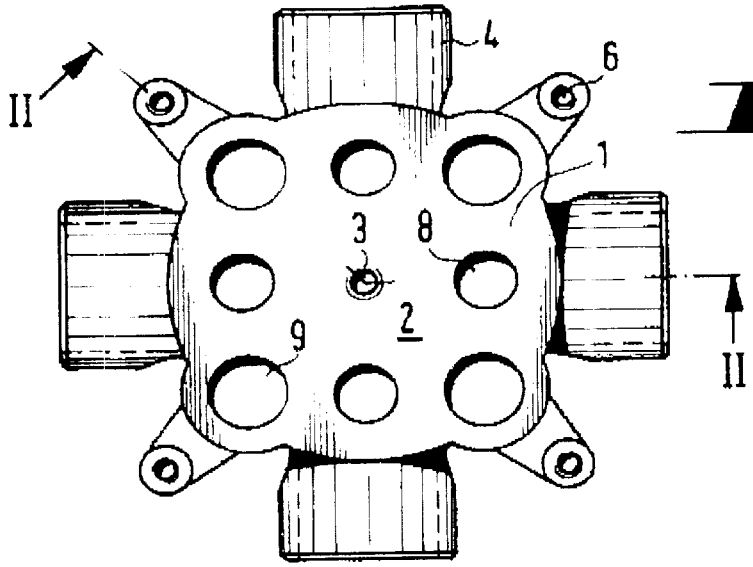

The sanitary fittings are fitted to a functional block, which has a joint face cooperating with the joint face of the connecting block and channels emanating from said joint face.

14 Claims, 2 Drawing Sheets

SYSTEM OF SANITARY FITTINGS

A system of sanitary mixer fittings is known (DE 19622368), in which an identical connecting casing can receive with the aid of a plurality of cartridge adaptors a set of mixer fittings. The universal casing contains two depressions, whereof one is constructed for receiving the adaptor and the other for receiving valve parts.

The problem of the invention is to provide a system of sanitary fittings, which has a simple construction and which can easily be installed.

For solving this problem the invention proposes a system of sanitary fittings having the features of claim 1. Further developments of the invention form the subject matter of dependent claims, whose wording, like that of the abstract, is by reference made into part of the content of the description.

The installer or plumber firstly connects and fits the connecting block with the water pipes of the house plumbing. After fitting the pipes can be flushed and their compression strength checked. After completing the construction work the user still has a possibility of choosing which sanitary fitting is to be fitted to the connecting block. He can not only choose the colour or shape of the fitting, but also the nature thereof. It is possible to fit both thermostatically controlled fittings, single lever mixers or other fittings. There is no need to use all the connecting pipes or through openings of the joint face of the connecting block. It is e.g. possible for the connecting pipe intended for the mixing water to be unused.

According to a further development of the invention, the sanitary fitting has a fitting body or structure, which has the fitting-side joint face and channels or ducts leading from the latter to the sanitary fitting. Thus, the fitting body is on the one hand adapted to the joint face of the connecting block and on the other to the fitting parts to be housed in it, e.g. valve tops or mixer cartridges.

According to a further development of the invention, the fitting body can be connected in at least two different positions to the connecting block and consequently also the sanitary fitting. Thus, independently of the arrangement of the pipes of the house plumbing, the user-desired or prescribed orientation of the sanitary fitting is possible. In particular, the two positions can be displaced by 180°.

The fitting body can e.g. be screwed directly to the connecting block. For this purpose the latter can have tapped holes into which the fixing screws can be screwed.

According to a further development of the invention, by fixing the fitting body to the connecting block it is simultaneously possible to provide the water connection. It can both be a connection of the running water from the entrance pipes to an outflow in the sanitary fitting and to an outlet, which is located at the mixing water pipe, to which the connecting block is connected, or connections to hollow chambers, e.g. for sound absorbers or silencers.

According to the invention, all the functional parts of the sanitary fitting are placed on the side of the joint face facing the fitting, so that the connecting block only provides the actual connection to the installation pipes and makes available openings connected to said pipes in the joint face. According to a further development the joint face can be flat. This makes it possible to give the connecting block a very shallow construction, so that it requires little space perpendicular to the wall surface.

According to the inventions in its joint face the connecting block can additionally have at least one blind hole. This blind hole can e.g. form the space necessary for housing a silencer.

The connecting block is advantageously constructed in such a way that it can be fitted in different positions, e.g. turned by 90 or 180°. For this purpose all the pipe connections of the connecting block can be identical and therefore interchangeable.

According to the invention, two pipe connections of the connecting block are interconnectable through the sanitary fitting and/or fitting body.

According to the invention, the fitting body not only receives a single sanitary fitting, but also more than one fitting, For example, the fitting body can receive a mixer fitting and an outflow reverser, which can be two completely separate parts.

According to the invention, the sanitary fitting has conventional cartridges.

Figure 2:
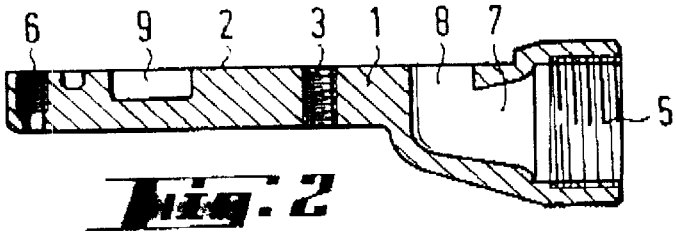

Other features, details and advantages of the invention can be gathered from the following description of a preferred embodiment with reference to the attached drawings wherein show:

FIG. 1 A plan view of a connecting block for the system according to the invention, FIG. 2 An angled section along line II—II in FIG. 1.

Figure 3:
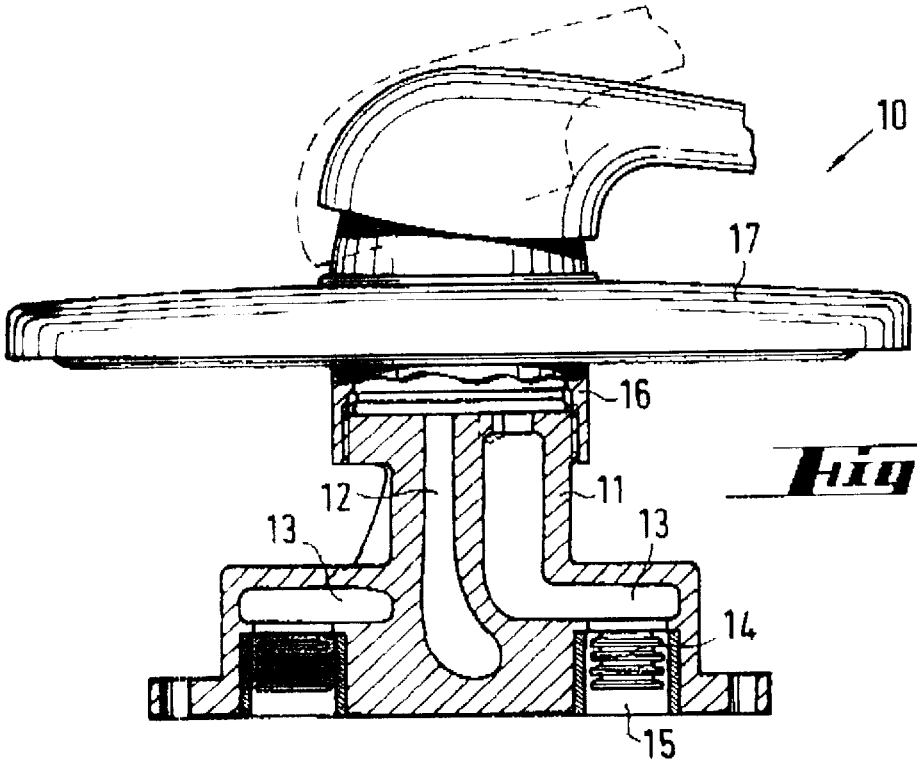

FIG. 3 A part sectional side view of a shower valve to be connected to the connecting block.

Figure 4:
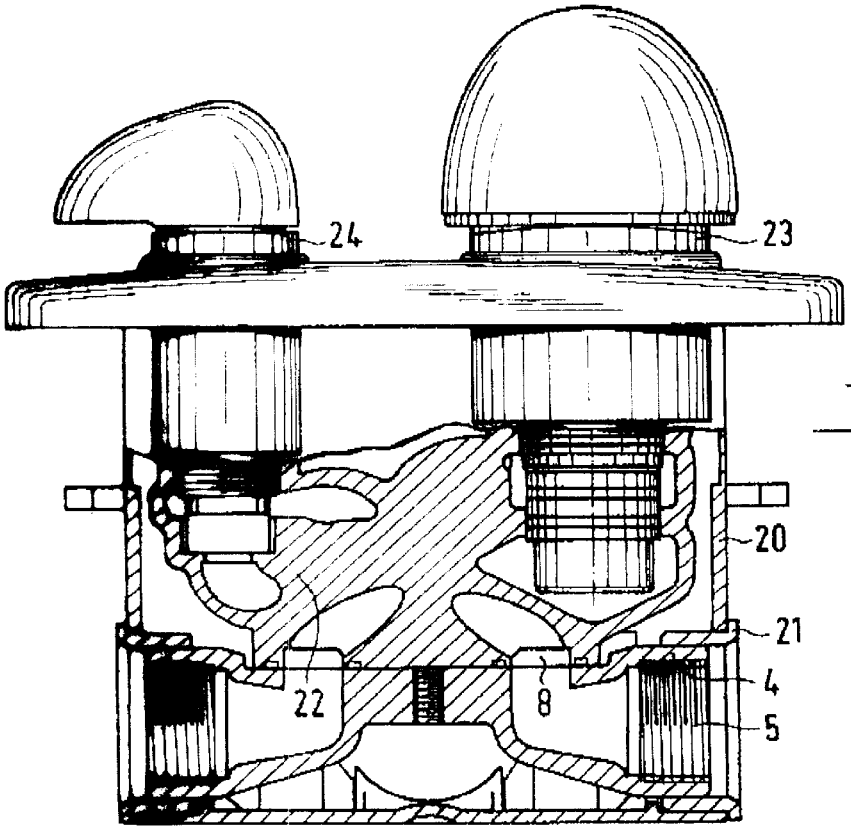

FIG. 4 A part sectional side view of a check valve-equipped thermostatically controlled valve fixing to the connecting block.

Figure 5:
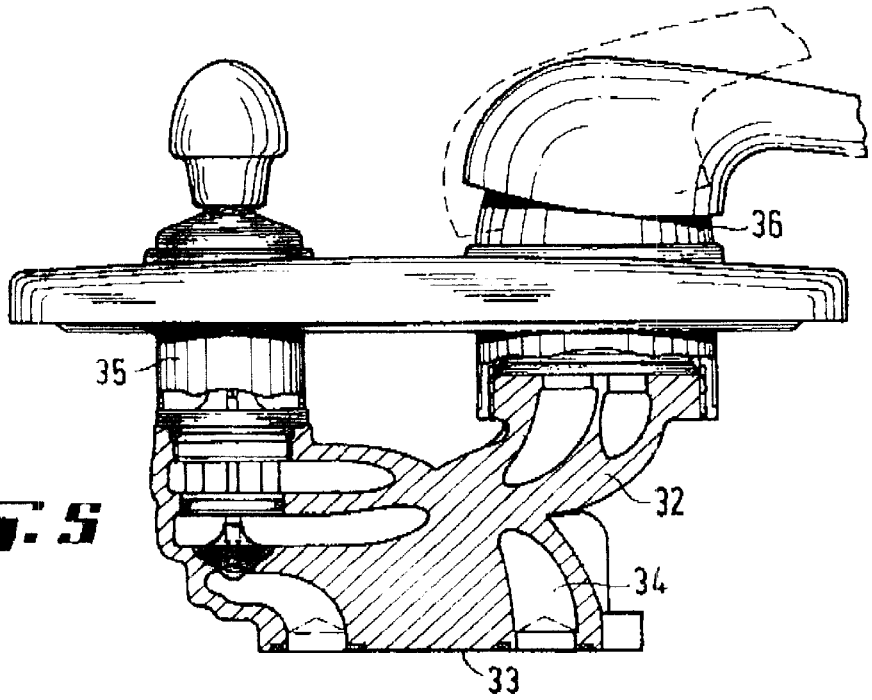

FIG. 5 A part sectional side view of a bath or tub valve.

FIG. 1 is a view of a connecting block, as proposed by the present invention as a common part for all sanitary fittings, The connecting block contains a central, plate-like component 1 with a planar surface 2. In the centre of said surface 2 there is a tapped hole 3 perpendicular to the surface and which forms the centre axis of the connecting block 1. There are four connections 4 emanating radially from said centre axis and in each case displaced by 90° and each of which has an internal thread 4 or a plug receptacle. Into the connections 4 can be screwed plumbing installation pipes. These can be pipes from which the water flows, or pipes into which the water flows. For example, two connections can be connected to the hot and cold water supply, whereas two farther connections 4 are connected to a bath tub outlet and a shower outlet.

In each case centrally between two connection 4 are provided further tapped holes 6, which are located on projections of the connecting block. The tapped holes 3 and 6 serve to screw to the connecting block a sanitary fitting having a corresponding joint face.

According to FIG. 2, each connection 4 is connected by means of an angled channel or duct 7 to a through opening 8, which issue into the planar joint face 2 of the connecting block. Centrally between the through openings 8 there are depressions 9 in the joint face 2 and which have no further connection;

FIG. 3 shows a sanitary fitting 10, which can be fitted with the aid of a sectionally represented fitting structure or body 11 to the connecting block of FIGS. 1 and 2. The sanitary fitting 10 is a single lever mixer valve, in which the outflow through the valve is returned back to the connecting block. The mixer valve is screwed to the fitting body 11. The fitting body contains channels 12, whereof only one can be seen in the drawing and which carry the hot and cold water to the mixer valve, together with a channel passing the mixed water to a connection 4, which is connected to a pipe leading to the shower head. The sectional view of FIG. 3 is placed through a plane, which on fixing to the connecting block interconnects two tapped holes 6. Here the fitting body 11 contains channels 13, in each of which is placed a silencer or sound absorber 14. The latter is located in an area 15 which continues into the depression 9.

To the outer cover 16 of the mixer valve is fixed a collar 17, which terminates the wall opening in which the connecting block is housed.

FIG. 4 is a view in which the cross-section through the connecting block is placed through the axis of two connections 4. The connecting block is housed in a concealed tank 20, in that it is fixed by short connecting pieces 21 being screwed or plugged in through openings of said concealed tank and which engage from the outside round the connections 4.

To the joint face 2 of the connecting block is also fixed a fitting body 22, which has a completely different appearance here to the fitting body 11 of FIG. 3. It contains a plurality of channels, which form connections between the through openings 8 of the connecting block and the sanitary fittings. In this case the fitting body 22 contains a receptacle for a thermostatically controlled valve 23 and a check valve 24. These two valves are independently operable valves, but which cooperate with receptacles in the functional block 22.

FIG. 5 shows a fitting body 32, which forms on its underside a joint face 33, which cooperates with the joint face 2 of the connecting block. This fitting body 32 can also be screwed to the connecting block and contains channels 34 forming connections between the through openings 8 of the connecting block and the sanitary fittings. In the case shown the fitting body 32 contains a receptacle for a reversing valve 35 and a single lever mixer valve 36.

In the system of fittings proposed by the invention the connecting block is identical for all the fittings, whereas the fitting body is so constructed on its side facing the connecting block that all the fitting bodies are operable together with the identical connecting block. On its opposite side the fitting body is in each case adapted to the fittings part to be received.

What is claimed is:

1. System of sanitary fittings having a connecting block identical for all the sanitary fittings and having four connections including a connection for a water inlet pipe, and a connection for a mixing water outlet pipe and a joint face with through openings, which are connected to in each case one connection of the connecting block, a plurality of different sanitary fittings, which have a joint face with through openings and can be so fitted to the connecting block that the sanitary fitting is operable, wherein the sanitary fittings have a fitting body which has the joint face and channels leading from the latter to the sanitary fitting parts, and the fitting body has functional parts of the sanitary fittings, and the fitting body can be connected to the connecting block in at least two different positions.

2. System according to claim 1, wherein the fitting body can be connected to the connecting block in four different positions.

3. System according to claim 2, wherein the four positions are displaced by 90°.

4. System according to claim 1, wherein the fitting body can be screwed directly to the connecting block.

5. System according to claim 1, wherein the water connection can be simultaneously provided through the fixing of the fitting body to the connecting block.

6. System according to claim 1, wherein all the functional parts are located in at least one of the fitting body and the sanitary fitting.

7. System according to claim 1, wherein the joint face of the connecting block is flat.

8. System according to claim 1, wherein the connecting block has in its joint face at least one blind hole.

9. System according to claim 1, wherein the pipe connections of the connecting block are identical to each another.

10. System according to claim 1, wherein two pipe connections of the connecting block are interconnectable through the sanitary fittings.

11. System according to claim 1, wherein the fitting body receives parts of more than one sanitary fitting.

12. System according to claim 1, wherein all the functional parts are located in the sanitary fitting.

13. System according to claim 1, wherein the connecting block has two connections for inlet pipes and two connections for outlet pipes.

14. System according to claim 1, wherein the connecting block has one connection for an inlet pipe and three connections for outlet pipes.

* * * * *